US007108777B2

(12) United States Patent
Xu et al.

(10) Patent No.: US 7,108,777 B2
(45) Date of Patent: Sep. 19, 2006

(54) HYDROGEN-ASSISTED ELECTROLYSIS PROCESSES

(75) Inventors: Jianguo Xu, Wrightstown, PA (US); Michael Kelly, Plainsboro, NJ (US); Guido Pez, Allentown, PA (US); Ying Wu, Red Bank, NJ (US); Stefanie Sharp-Goldman, East Brunswick, NJ (US)

(73) Assignees: Millennium Cell, Inc., Eatontown, NJ (US); Air Products and Chemicals, Inc., Allentown, PA (US)

( * ) Notice: Subject to any disclaimer, the term of this patent is extended or adjusted under 35 U.S.C. 154(b) by 212 days.

(21) Appl. No.: 10/388,197

(22) Filed: Mar. 13, 2003

(65) Prior Publication Data

US 2004/0011662 A1 Jan. 22, 2004

Related U.S. Application Data

(60) Provisional application No. 60/405,558, filed on Aug. 23, 2002, provisional application No. 60/380,384, filed on May 14, 2002, provisional application No. 60/364,643, filed on Mar. 15, 2002.

(51) Int. Cl.

| | |
|---|---|
| ***C25C 3/02*** | (2006.01) |
| *C25B 1/14* | (2006.01) |
| *C25B 1/16* | (2006.01) |

(52) U.S. Cl. ..... 205/408; 205/358; 205/406; 205/407

(58) Field of Classification Search ..... 205/406–409, 205/546, 358; 423/286–288

See application file for complete search history.

(56) References Cited

U.S. PATENT DOCUMENTS

| | | | | |
|---|---|---|---|---|
| 745,958 | A * | 12/1903 | Ewan | 205/354 |
| 2,148,404 | A * | 2/1939 | Gilbert | 205/409 |
| 2,534,533 | A | 12/1950 | Schlesinger et al. | |
| 3,210,157 | A | 10/1965 | Lewis, Jr. et al. | |
| 3,265,490 | A * | 8/1966 | Shiro et al. | 75/388 |
| 3,505,035 | A * | 4/1970 | Schubert et al. | 423/288 |
| 3,607,684 | A * | 9/1971 | Kuhn | 205/356 |
| 3,734,842 | A | 5/1973 | Cooper | |
| 4,389,287 | A * | 6/1983 | Skala | 205/346 |
| 4,988,417 | A | 1/1991 | DeYoung et al. | |

FOREIGN PATENT DOCUMENTS

| | | |
|---|---|---|
| CN | 1396307 A | 2/2003 |
| EP | 1 059 366 A | 12/2000 |
| JP | 07 090667 | 4/1995 |

OTHER PUBLICATIONS

Maurice E. Indig and Richard N. Snyder, "Sodium Borohydride, An Interesting Anodic Fuel". Journal of the Electrochemical Society, vol. 109, pp. 1104-1106, Nov. 1962.

International Search Report.

Gyenge, E.L., et al., "Electrosynthess Attempts Of Tetrahydridoborates," Journal of Applied Electrochemistry, 28:1147-1151 (1998).

* cited by examiner

*Primary Examiner*—Roy King
*Assistant Examiner*—Michael P. Alexander

(74) *Attorney, Agent, or Firm*—Dickstein Shapiro LLP

(57) ABSTRACT

A process and electrolytic cell for reducing in an ionic alkali metal compound, the cell containing anode and cathode electrodes, by supplying an electrolyte containing the alkali metal compound to the cell, applying an electric voltage to the cell to reduce said alkali metal compound at the cathode, and passing hydrogen or a hydrogen containing gas to at least one electrode while the compound is reduced at the cathode.

10 Claims, 5 Drawing Sheets

Hydrogen electrolysis of sodium hydroxide in molten NaOH

1. Cathode, 2. Catholyte, 3. Membrane, 4. Anode, 5. Anolyte, 6. Hydrogen sparger, 7. Molten sodium.

Figure 1. Hydrogen electrolysis of sodium hydroxide in molten NaOH
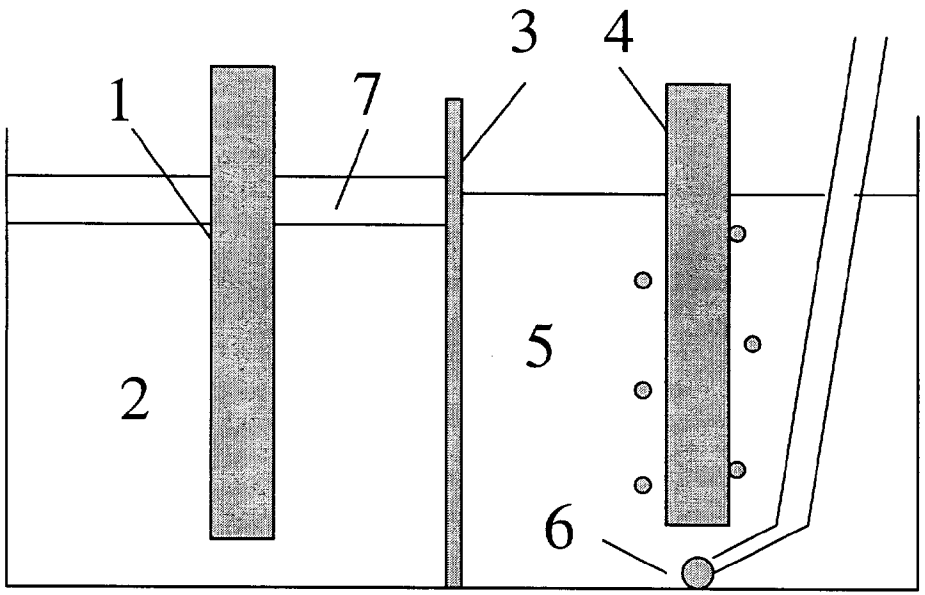
1. Cathode, 2. Catholyte, 3. Membrane, 4. Anode, 5. Anolyte, 6. Hydrogen sparger, 7. Molten sodium.

Figure 2. Electrolytic synthesis of sodium hydride in salt melt with hydrogen at the cathode
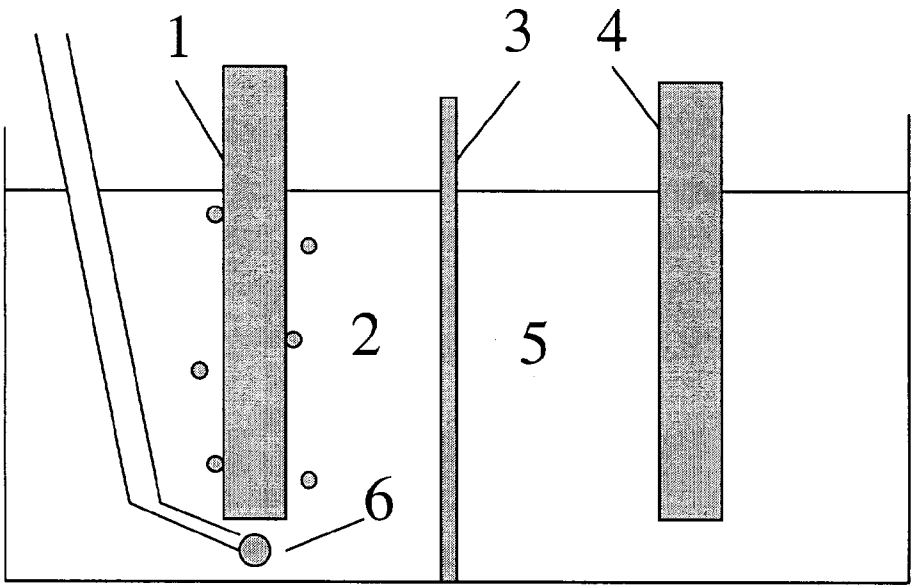
1. Cathode, 2. Catholyte, 3. Membrane, 4. Anode, 5. Anolyte, 6. Hydrogen sparger.

Figure 3. Hydrogen electrolytic synthesis of sodium hydride in salt melt with hydrogen at the cathode and anode
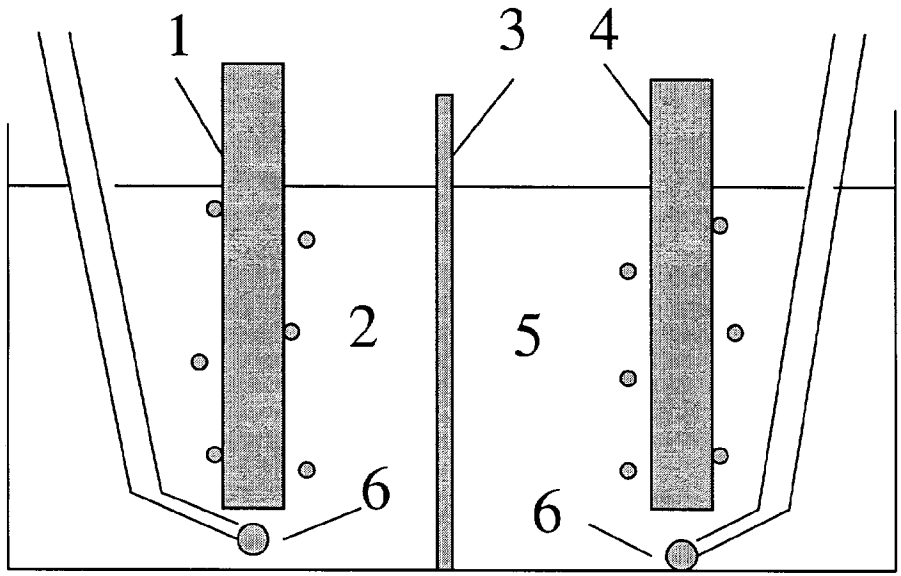
1. Cathode, 2. Catholyte, 3. Membrane, 4. Anode, 5. Anolyte, 6. Hydrogen sparger.

Figure 4. Hydrogen electrolytic synthesis of sodium borohydride in salt melt
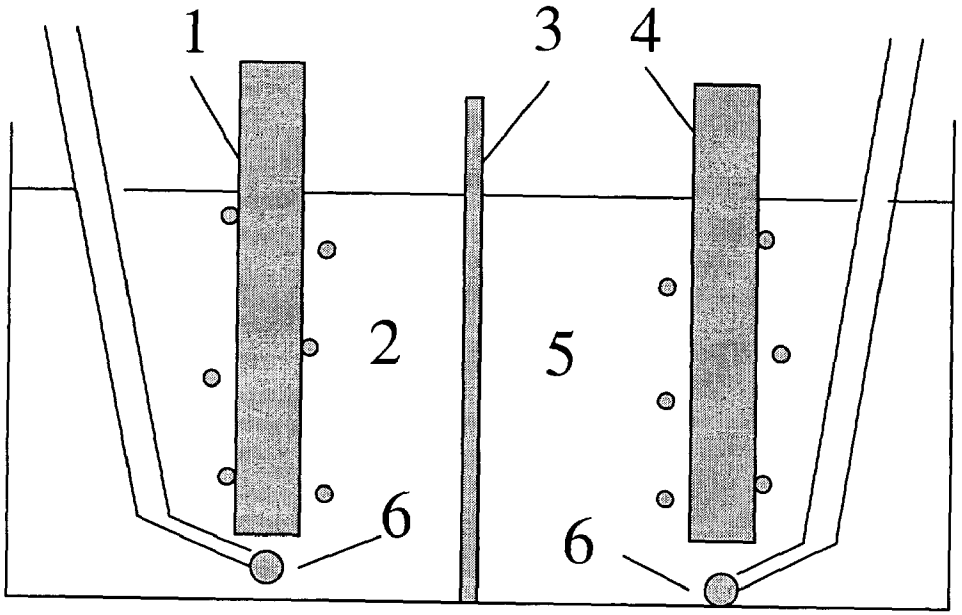
1. Cathode, 2. Catholyte, 3. Membrane, 4. Anode, 5. Anolyte, 6. Hydrogen sparger.

Figure 5. Hydrogen electrolysis of NaOH in aqueous solution to form Na-amalgam
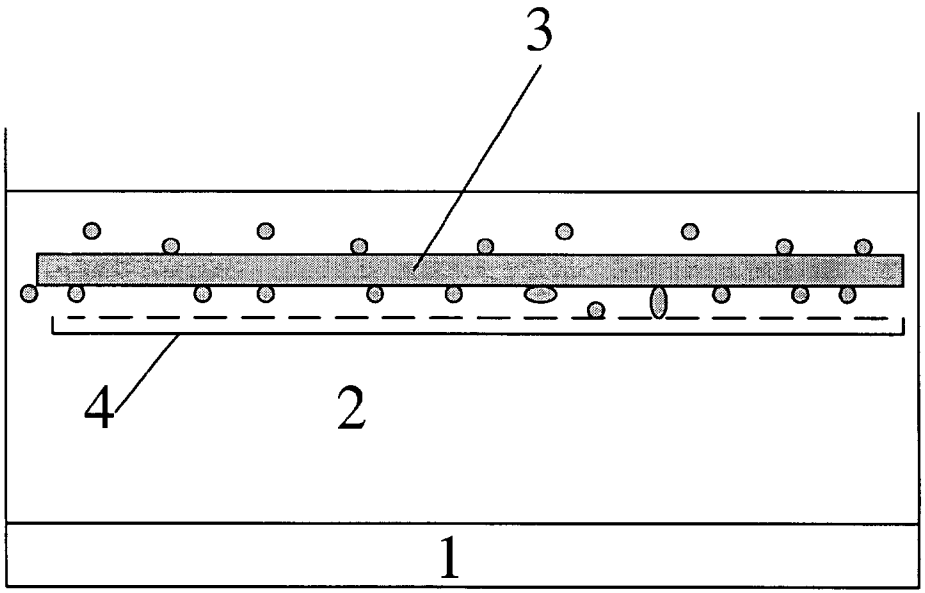
1. Cathode, 2. Electrolyte, 3. Anode, 4. Hydrogen sparger.

HYDROGEN-ASSISTED ELECTROLYSIS PROCESSES

CROSS REFERENCE TO RELATED APPLICATIONS

This Application claims priority of U.S. Ser. No. 60/364,643, filed Mar. 15, 2002, U.S. Ser. No. 60/380,384, filed May 14, 2002 and U.S. Ser. No. 60/405,558, filed Aug. 23, 2002 incorporated herein by reference.

FIELD OF INVENTION

The field of this invention is directed to electrochemical reduction of alkali metal containing inorganic compounds by hydrogen-assisted electrolysis, with applications to alkali metal, alkali metal hydride, and alkali metal borohydride production.

BACKGROUND OF THE INVENTION

Electrochemical processes are important in the chemical industry, but they are also large consumers of energy. For example, the electrochemical production of inorganic chemicals and metals in the United States consumes about 5% of all the electricity generated annually, and about 16% of the electric power consumed by industry. Energy consumption is a very important cost of production, and in many larger scale electrochemical manufacturing processes, it is the dominant cost. Therefore, it is desirable to find ways to significantly reduce this cost.

One way to reduce electricity consumption in electrochemical processes is to use a cheap reducing material as an anode material. This reducing material is oxidized in the electrolytic process to reduce cell voltage. This method is used in the electrolysis of alumina for aluminum production using the Hall and Heroult process. A carbon anode is used and consumed in the electrolytic process, forming carbon dioxide as a product. This allows the cell voltage to drop by about 1 volt.

Another cheap reducing material that could be employed is hydrogen gas. Hydrogen can be obtained from steam reforming natural gas in a highly thermally efficient process, typically 70–80%. The associated processing costs are low, such that typically ⅔ of the total cost of producing hydrogen is for the natural gas feedstock, an inexpensive commodity. As a consequence, the cost of hydrogen from a large hydrogen plant is currently on the order of about $0.8/kg, or about $0.025/kWh in its Gibbs free energy of combustion.

It is also known that the overvoltage of a fuel cell anode in which hydrogen gas is converted to protons by electron extraction is rather low, typically below 0.1 V at the typical current density of a fuel cell, much lower than that on the fuel cell cathode, and much lower than the overpotentials on the anodes of electrochemical cells that release oxygen.

These facts suggest using hydrogen gas at anodes to lower the overall cell voltage and to lower overpotential on the anode side of an electrolytic cell during any electrolytic reduction. There are several benefits in using hydrogen. For instance, hydrogen is inexpensive and readily available. The $0.025/kWh cited above compares favorably with the typical electricity cost of $0.05–0.07/kWh. The relatively low overvoltage of electron extraction from hydrogen is also attractive. These combined factors are a fundamental reason why hydrogen-assisted electrolysis shown in equations (1a) and (1b) may be the lower cost option in comparison to an electrolysis process that generates oxygen or other oxidizing agents at the anode, such as the electrolysis of sodium chloride to make sodium metal and chlorine gas shown in equations (2a) and (2b).

| | | |
|---|---|---|
| Cathode: | $2Na^+ + 2e^- \rightarrow 2Na$ | (1a) |
| Anode: | $2OH^- + H_2 - 2e^- \rightarrow 2H_2O$ | (1b) |
| Standard cell voltage = 1.46 V. | | |
| Cathode: | $Na^+ + e^- \rightarrow Na$ | (2a) |
| Anode: | $Cl^- - e^- \rightarrow ½Cl_2$ | (2b) |
| Standard cell voltage = 3.42 V. | | |

Furthermore, hydrogen can be used not only to reduce electricity consumption, but also to produce the desired final products in the electrolysis process without additional reaction steps. For example, the largest consumer of sodium metal in the United States is the process for making sodium borohydride. The first step of sodium borohydride synthesis is to convert sodium to sodium hydride by direct reaction of the two elements. By supplying hydrogen to the cathode during electrolysis, sodium hydride could be made directly.

Sodium borohydride is a very versatile chemical and is used in organic synthesis, waste-water treatment, and pulp and paper bleaching. The high hydrogen content of this compound also makes it a good candidate for being a hydrogen carrier, and it could play a major role as an enabler of a hydrogen economy if the cost of producing this chemical could be greatly reduced. Transitioning to a hydrogen economy for energy production would solve a number of environmental problems related to burning fossil fuel for electricity and mechanical energy generation.

Several processes exist for making sodium borohydride, all of which depend on metallic sodium or sodium hydride as a starting material. Essentially, all sodium in the marketplace is obtained from energy inefficient electrolysis processes, such as electrolysis of sodium chloride. Due to this, the market price of sodium is quite high and this raises the cost of raw materials for making sodium borohydride. Therefore, it is desirable to reduce the cost of making sodium.

Today's workhorse for producing sodium borohydride is the so-called Schlesinger process which is a multi-step synthetic process. The cost of running several steps also adds significantly to the total manufacturing cost. Direct electrolytic synthesis has the advantage of simplicity, and therefore has the potential to be lower in capital cost. Electrochemical processes can take place closer to chemical equilibrium than many non-electrochemical processes. In addition, a one-step transformation by direct electrolytic synthesis has the potential to greatly reduce energy cost. There have been reports of electrochemical synthesis of sodium borohydride from aqueous sodium metaborate solution in the patent literature (U.S. Pat. No. 3,734,842, U.S. Pat. No. 4,904,357, and U.S. Pat. No. 4,931,154). These processes involve conversion of sodium metaborate and water to form sodium borohydride and oxygen in an electrical cell as shown in the following half cell reactions:

| | | |
|---|---|---|
| Cathode: | $B(OH)_4^- + 4H_2O + 8e^- \rightarrow BH_4^- + 8OH^-$ | (3a) |
| Anode: | $8OH^- - 8e^- \rightarrow 4H_2O + 2O_2$ | (3b) |
| Standard cell voltage = 1.64 V. | | |

SUMMARY OF THE INVENTION

The invention is directed to process and apparatus for reducing in an electrolytic cell any ionic alkali metal compound by utilizing hydrogen or a hydrogen-containing gas. In accordance with one embodiment of this invention the hydrogen gas can be provided at the anode to reduce cell potential or at both the anode and cathode to reduce cell potential and provide source hydrogen for the formation of the reduction product, thereby achieving an efficient and costeffective process.

In accordance with an embodiment of the invention, hydrogen or a hydrogen-containing gas can be provided only at the cathode to provide a reactant for the reduced form of the ionic alkali metal compound such as in the production of an alkali metal hydride from an alkali metal hydroxide.

In accordance with one aspect of this invention hydrogen or hydrogen-containing gas is utilized at the anode electrode for reducing in an electrolytic cell any ionic alkali metal compound. In accordance with this first aspect of this invention, the ionic alkali metal compound is electrolytically reduced to a reduced form of this alkali metal compound in an electrolytic cell which contains anode and cathode compartments This reduction is carried out by supplying to the cell the alkali metal compound to be reduced and applying electric voltage to said cell to reduce the alkali metal compound at the cathode. This aspect of the invention is carried out by passing hydrogen or a hydrogen containing gas to the anode compartment or at both the anode and cathode compartments while said compound is reduced at the cathode. In this embodiment a molten alkali metal compound is supplied to at least the cathodic compartment or to both the cathodic and anodic compartments with at least the cathodic compartment being substantially free of water. The anodic and cathodic compartments are separated by a membrane which is permeable to alkali metal ions but is not permeable to water and water vapor. In accordance with this aspect of the invention, the electrochemical processes for reducing ionic alkali metal containing compounds, particularly sodium hydroxide where sodium metal is desired, can be effectively and efficiently carried out at lower voltages. In accordance with this aspect of the invention, the use of hydrogen gas at the anode or at both the anode or cathode to assist electrolysis, provides an economic method, utilizing inexpensive materials, for generating alkali metals such as sodium and reduced alkali metal compounds such as sodium hydride and sodium borohydride.

In the second aspect of this invention, hydrogen-assisted electrochemical reactions where hydrogen is used at the cathode and the electrolyte is present in a molten state provides source hydrogen to make hydrogen containing products like sodium hydride and sodium borohydride which would not readily form without hydrogen. The hydrogen gas can be passed into the cathode compartment as a gas from an outside source. In accordance with this process for electrolytically converting an alkali metal borate into a borohydride, the cathodic compartment contains an alkali metal borate dissolved in molten ionic salt whereas a molten solution of sodium hydroxide, either with or without additional ionic salt dissolved in it, is provided to the anodic compartment of this cell. The cell contains a membrane, which is permeable only to alkali metal ions and is non-permeable to other ions, water or water vapor. Hydrogen is present in said cathodic compartment while an electric voltage is applied to the cell to electrolytically reduce the borate to the borohydride.

BRIEF DESCRIPTION OF THE DRAWINGS

FIG. 1 is the schematic view of the hydrogen electrolytic cell where hydrogen containing gas is passed into the anode for synthesis of an sodium metal in molten sodium hydroxide.

FIG. 2 is a schematic view of the hydrogen-assisted electrolysis cell utilizing a hydrogen containing gas at the cathode for the production of sodium hydride from a sodium hydroxide melt.

FIG. 3 is the schematic view of the electrolytic cell with hydrogen or a hydrogen containing gas at both the anode and cathode for the synthesis of sodium metal hydride from a sodium hydroxide melt.

FIG. 4 is a schematic view of the electrolytic cell with hydrogen or a hydrogen containing gas at both the anode and cathode for the synthesis of sodium borohydride from a hydroxide melt containing sodium metaborate.

FIG. 5 is a schematic view of the hydrogen-assisted electrolysis cell for the production of sodium amalgam.

DETAILED DESCRIPTION

In accordance with the first aspect of this invention involving the assistance of hydrogen or a hydrogen containing gas at the anode, an ionic alkali metal compound can be reduced in a cost-efficient and effective manner. This reduction occurs through the use of hydrogen or a hydrogen containing gas passed into the anodic compartment or through both the anodic and cathodic compartments to reduce the ionic alkali metal compound at the cathode. This reduction is carried out by applying an electric voltage to the electrolytic cell to reduce the alkali metal compound in the cathodic compartment while the hydrogen or the hydrogen containing gas is passed into the anodic compartment. This reduction is carried out by supplying the molten alkali metal compound to be reduced at the cathodic compartment which compartment is substantially free of water. In accordance with one embodiment of this aspect of the invention, both the anodic and cathodic compartments are substantially free of water. The anodic and cathodic compartments are separated by a membrane which is permeable to alkali metal ions but is not permeable to water and water vapor. This aspect is carried out in an electrochemical cell which contains an anode and a cathode compartments and connectors for said anode and cathode to an electrical source as well as means for supplying hydrogen or a hydrogen containing gas from an external source to said electrochemical cell at said anode. Generally any conventional means for supplying hydrogen or a hydrogen containing gas such as a pipe, a sparger, a hose, or a hydrogen gas diffusion material can be utilized to supply the hydrogen or hydrogen containing gas to the compartments of the cell.

In accordance with this aspect of the invention, any ionic alkali metal compound, preferably ionic alkali metal compounds, can be reduced. The ionic alkali metal compound can be either a salt of an alkali metal or a hydroxide of an alkali metal since all of these types of compounds can undergo reduction through the use of the cell in accordance with this invention. As used herein, alkali metal includes all of the conventional alkali metals such as lithium, sodium and potassium. The molten alkali metal compound can be either in the form of a solution or a melt so that charges can be transported within the compound. In accordance with the preferred embodiment of this invention, the alkali metal is sodium. The preferred alkali metal ionic compounds are sodium borate and sodium hydroxide. The term sodium borate as used throughout this application includes sodium metaborate such as $NaBO_2$ or the hydrates of sodium metaborate such as $NaB(OH)_4$ as well as borax such as $Na_2B_4O_7$ and the hydrate of borax such as $Na_2B_4O_7.10\ H_2O$, $Na_2B_4O_7.5\ H_2O$, and $Na_2B_4O_7.2\ H_2O$. In reductions where sodium hydroxide is used, the reduced product generally is sodium; where sodium borate is utilized in the cathode compartment, the reduced product is sodium borohydride.

While illustrating the various embodiments of this invention, sodium is utilized as the alkali metal, it is clear that in accordance with this invention any alkali metal can be utilized. These alkali metals include lithium, potassium, etc. In these embodiments, the alkali metal compound to be reduced is supplied to the cell in its molten form. This molten form or state includes the molten compound itself formed through a melt of this compound or a solution of this compound formed by dissolving the compound in a molten solvent.

By substantially free of water as used herein, it is meant that there is either a total absence of water or at most small amounts of water i.e. up to about 2% by weight present. Where the reactions are carried out under conditions which are substantially free of water, these reactions can be carried out without any water or at most only small amounts of water, i.e., up to about 2% by weight.

FIG. 1 illustrates one embodiment of the invention whereby hydrogen or a hydrogen containing gas passed through the anode assists the reduction. In this embodiment a molten ionic alkali metal compound is reduced to an alkali metal. In accordance with this embodiment the reaction is carried out in a molten salt medium through the use of an electrolytic cell. In such cases the ionic alkali metal compounds is preferably an alkali metal hydroxide, particularly sodium hydroxide as illustrated in this process. In this process sodium hydroxide is electrolyzed in an electrolytic cell to produce metallic sodium. The electrolytic reaction that is carried out in accordance with FIG. 1 is set forth by the following equations:

| | | |
|---|---|---|
| Cathode: | $2Na^+ + 2e^- \rightarrow 2Na$ | (1a) |
| Anode: | $2OH^- + H_2 - 2e^- \rightarrow 2H_2O$ | (1b) |
| Standard cell voltage = 1.46 V. | | |

In accordance with this embodiment, the electrolytic cell is used for carrying out the process for producing an alkali metal in accordance with FIG. 1 which employs the reactions illustrated in (1a) and (1b). In this process sodium hydroxide is electrolytically converted to sodium metal in an electrolytic cell which contains anodic and cathodic compartments. In accordance with this process, a molten alkali metal hydroxide is placed in the cathodic compartment. A molten alkali metal hydroxide is also placed into the anodic compartment. Each of said compartments are separated by a membrane which is not permeable to water, or water vapor but permeable to cations of the alkali metal. In addition at least the cathode compartment should be substantially free of water. To this cell, a voltage is applied so that a current flows through the electrolytic cell, and hydrogen or a hydrogen containing gas is supplied to the anode surface during the application of this voltage. In this manner, the alkali metal is formed in the cathodic compartment. As seen from the equations (1a) and (1b), when hydrogen gas is applied in accordance with this invention, the standard voltage necessary to convert the alkali metal hydroxide to the reduced metal is approximately 1.46 volts at 350° C. The reaction without utilizing hydrogen gas as seen from the prior art methods, requires a voltage greater than 2.44 volts to convert the alkali metal hydroxide to the alkali metal at 350° C. in accordance with equations (4a) and (4b).

| | | |
|---|---|---|
| Cathode: | $2Na^+ + 2e^- \rightarrow 2Na$ | (4a) |
| Anode: | $2OH^- - 2e^- \rightarrow H_2O + ½O_2$ | (4b) |
| Standard cell voltage = 2.44 V. | | |

In the cell of FIG. 1, the cathodic compartment contains the cathode electrode 1 and the catholyte 2, which is molten sodium hydroxide. The anodic compartment contains the anode electrode 4 and the anolyte 5 which is molten sodium hydroxide. The anodic compartment is supplied with a hydrogen sparger 6 for supplying hydrogen or a hydrogen containing gas from an external source to said anode 5. The membrane 3 should be non-permeable to water and water vapor which are produced in the electrochemical reaction while permeable to alkali metal ions.

In accordance with this embodiment, when a voltage is applied to the cell across the cathode electrode 1 and the anode electrode 4, while the hydrogen gas is passed to the anode by means of the sparger 6, the reaction of (1a) and (1b) takes place to convert the alkali metal hydroxide to the alkali metal. In this manner the metal is produced in the cathodic compartment. As seen from the above equations, (1a) and (1b), the standard voltage necessary to carry out this reaction is approximately 1.46 volts. The reaction without hydrogen, as illustrated in equations (4a) and (4b) requires a standard voltage of 2.44 volts. In carrying out the reaction of formula (1a) and (1b), voltages from 1.46 volts to 6 volts are generally utilized. Higher voltages can be used but seldom are since high voltages are energy inefficient when carrying out this process.

In carrying out the reaction in the cell of FIG. 1, a voltage is applied across the anode and cathode so that a current flows through the electrolytic cell while hydrogen or a hydrogen containing gas is passed into the anodic compartment to convert the hydroxyl ion into water. It is important that the membrane 3 does not allow water or water vapor to pass into the cathodic compartment.

The membrane should be composed of a material which is permeable to alkali metal cations and non-permeable to water and water vapor and which can also withstand temperatures of the reaction, i.e. 100° C. or above. Generally this reaction is carried out at 100° C. to 500° C. depending upon the material present as the membrane and the melting points of the catholyte and anolyte. Generally it is preferred that the membrane 3 be made from a cation-exchange ceramic material such as sodium β"-alumina. In accordance with this embodiment, the cathode can be made of conventional metals which are inert at the high temperatures used for this reaction. Examples of such materials include nickel, copper, stainless steel etc. A hydrogen diffusion electrode with a high specific surface area is preferred for the anode. Such electrodes may include nickel or supported noble metals such as platinum supported on porous nickel or titanium.

This reaction has a standard voltage of 1.46 volts. Cell voltages from 1.46 volts to 6 volts or above can be utilized to carry out this reaction. Generally this reaction is carried out at temperatures which will keep the anolyte and catholyte (sodium hydroxide) in their molten state. In this regard any temperature which will keep the anolyte and catholyte in their molten state can be utilized. In most cases these are temperatures of at least 300° C. and preferably between 318° C. and 500° C. As the sodium in the cathodic compartment is produced in the electrolysis process it floats to the top of the catholyte as molten layer 7. This molten layer 7 can be continuously or intermittently removed from the cell. The feed molten sodium hydroxide can continuously or intermittently be introduced into the cell and this reaction can be carried out in a continuous or intermittent manner.

FIG. 2 illustrates another embodiment of the invention whereby hydrogen or a hydrogen containing gas is passed through the cathode to produce the desired final product, alkali metal hydride. In this embodiment hydrogen or a hydrogen containing gas is reduced to hydride ions in a molten inorganic ionic alkali metal. In accordance with this embodiment the reaction is carried out in a molten salt medium through the use of an electrolytic cell. In such cases the inorganic ionic alkali metal compounds should be an alkali metal hydroxide, particularly sodium hydroxide as illustrated in this process. In this process sodium hydroxide is electrolyzed in an electrolytic cell to produce sodium hydride. The electrolytic reaction that is carried out in accordance with FIG. 2 is set forth by the following equations:

| | | |
|---|---|---|
| Cathode: | $2Na^+ + H_2 + 2e^- \rightarrow 2NaH$ | (5a) |
| Anode: | $2OH^- - 2e^- \rightarrow H_2O + \frac{1}{2}O_2$ | (5b) |
| Standard cell voltage = 2.37 V. | | |

In accordance with this embodiment, the electrolytic cell is used for carrying out the process for producing an alkali metal in accordance with FIG. 2 which employs the reactions illustrated in (5a) and (5b). In this process sodium hydroxide is electrolytically converted to sodium hydride in an electrolytic cell which contains anodic and cathodic compartments. In accordance with this process, a molten alkali metal hydroxide is placed in the cathodic compartment. A molten alkali metal hydroxide is also placed into the anodic compartment. In this embodiment at least the cathodic compartment is substantially free of water. However both compartments may be substantially free of water. The two compartments are separated by a membrane not permeable to water, or water vapor but permeable to cations of the alkali metal. To this cell, a voltage is applied so that a current flows through the electrolytic cell, and hydrogen or a hydrogen containing gas is supplied to the cathode surface during the application of this voltage. In this manner, the alkali metal hydride is formed in the cathodic compartment. As seen from the equations (5a) and (5b), when hydrogen gas is applied in accordance with this invention, the standard voltage necessary to convert the alkali metal hydroxide to the reduced metal is approximately 2.37 volts at 350° C. The reaction without utilizing hydrogen gas, as seen from the prior art methods, is not performed directly. A voltage greater than 2.44 volts is required to convert the alkali metal hydroxide to the alkali metal at 350° C. in accordance with equations (4a) and (4b), and a second separate reaction step is required to convert the alkali metal to alkali metal hydride. By using a lower voltage and only one reaction step, a savings is realized.

In the cell of FIG. 2, the cathodic compartment contains the cathode electrode 1 and the catholyte 2, which is molten sodium hydroxide. The anodic compartment contains the anode electrode 4 and the anolyte 5 which is molten sodium hydroxide. The cathodic compartment contains a hydrogen sparger 6 for supplying hydrogen or a hydrogen containing gas from an external source to said cathode 1. The membrane 3 which is permeable to alkali metal cations should be non-permeable to water and water vapor which are produced in the electrochemical reaction.

In accordance with this embodiment, when a voltage is applied to the cell across the cathode electrode 1 and the anode electrode 4, while the hydrogen gas is passed to the cathode by means of the sparger 6, the reaction of (5a) and (5b) takes place to convert the sodium hydroxide to sodium metal hydride. In this manner the hydride is produced in the cathodic compartment. As seen from the above equations, (5a) and (5b), the standard voltage necessary to carry out this reaction is approximately 2.37 volts. The reaction without hydrogen, as illustrated in equations (4a) and (4b) requires a standard voltage of 2.44 volts. In carrying out the reaction of formula (5a) and (5b), voltages from 2.37 volts to 6 volts are generally utilized. Higher voltages can be used but seldom are since high voltages are energy inefficient when carrying out this process.

In carrying out the reaction in the cell of FIG. 2, a voltage is applied across the anode and cathode so that a current flows through the electrolytic cell while hydrogen or a hydrogen containing gas is passed into the cathodic compartment to convert the hydrogen gas into hydride ions. It is important that the membrane 3 does not allow water or water vapor to pass into the cathodic compartment.

The membrane should be composed of a material which is permeable to alkali metal cations and not permeable to water and water vapor and which can also withstand temperatures of the reaction, i.e. 100° C. or above. Generally this reaction is carried out at 100° C. to 500° C. depending upon the material present as the membrane and the melting points of the catholyte and anolyte. Generally it is preferred that the membrane 3 be made from a cation-exchange ceramic material such as sodium β"-alumina. In accordance with this embodiment, the anode can be made of conventional metals which are inert at the high temperatures used for this reaction. Examples of such materials include nickel, platinum, stainless steel etc. A hydrogen diffusion electrode with a high specific surface area is preferred for the cathode. Such electrodes may include porous nickel or supported noble metals such as platinum supported on porous nickel or titanium.

This reaction has a standard voltage of 2.37 volts. Cell voltages from 2.37 volts to 6 volts or above can be utilized to carry out this reaction. Generally this reaction is carried out at temperatures which will keep the anolyte and catholyte (for instance, sodium hydroxide) in their molten state. In this regard any temperature which will keep the anolyte and catholyte in their molten state can be utilized. In most cases these are temperatures of at least 300° C. and preferably between 318° C. and 500° C. As the sodium hydride in the cathodic compartment is produced in the electrolysis process it dissolves in to the catholyte. This solute can be continuously or intermittently removed from the cell. The feed molten sodium hydroxide can continuously or intermittently be introduced into the cell and this reaction can be carried out in a continuous or intermittent manner.

FIG. 3 illustrates one embodiment of the invention whereby hydrogen or a hydrogen containing gas is passed through the anode and cathode to assist the reduction. In this embodiment a molten ionic alkali metal compound is reduced to an alkali metal hydride. In accordance with this embodiment the reaction is carried out in a molten salt medium through the use of an electrolytic cell. In such cases the ionic alkali metal compounds should be an alkali metal hydroxide, particularly sodium hydroxide as illustrated in this process. In this process sodium hydroxide is electrolyzed in an electrolytic cell to produce metallic sodium. The electrolytic reaction that is carried out in accordance with FIG. 3 is set forth by the following equations:

| | | |
|---|---|---|
| Cathode: | $2Na^+ + H_2 + 2e^- \rightarrow 2NaH$ | (6a) |
| Anode: | $2OH^- + H_2 - 2e^- \rightarrow 2H_2O$ | (6b) |
| Standard cell voltage = 1.39 V. | | |

In accordance with this embodiment, an electrolytic cell is used for carrying out the process for producing sodium hydride of FIG. 3 which employs the reactions illustrated in (6a) and (6b). In this process sodium hydroxide is electrolytically converted to sodium hydride in an electrolytic cell which contains anodic and cathodic compartments.

In accordance with this process, molten sodium hydroxide is placed in the cathodic compartment. Molten sodium hydroxide is also placed into the anodic compartment. In this embodiment at least the cathodic compartment is substantially free of water. The compartments are separated by a membrane not permeable to water, or water vapor but permeable to alkali metal cations. To this cell, a voltage is applied so that a current flows through the electrolytic cell, and hydrogen or a hydrogen containing gas is supplied to the anode and cathode surfaces during the application of this voltage. In this manner, the sodium hydride is formed in the cathodic compartment. As seen from the equations (6a) and (6b), when hydrogen gas is applied in accordance with this invention, the standard voltage necessary to convert the sodium hydroxide to the reduced metal is approximately 1.39 volts at 350° C. The reaction without utilizing hydrogen gas, as seen from the prior art methods, is not performed directly. A voltage greater than 2.44 volts is required to convert the sodium hydroxide to the sodium hydride at 350° C. in accordance with equations (4a) and (4b), and a second separate reaction step is required to convert the sodium metal to sodium hydride. By using a lower voltage and only one reaction step, a substantial savings is realized.

In the cell of FIG. 3, the cathodic compartment contains the cathode electrode 1 and the catholyte 2, which is molten sodium hydroxide. The anodic compartment contains the anode electrode 4 and the anolyte 5 which is molten sodium hydroxide. The anodic and cathodic compartments are supplied with hydrogen spargers 6 for supplying hydrogen or a hydrogen containing gas from an external source to said anode 4 and cathode 1. The membrane 3 should be non-permeable to water and water vapor which are produced in the electrochemical reaction while at the same time being permeable to alkali metal cations.

In accordance with this embodiment, when a voltage is applied to the cell across the cathode electrode 1 and the anode electrode 4, while the hydrogen gas is passed to the anode and cathode by means of the sparger 6, the reactions of (6a) and (6b) take place to convert sodium hydroxide to sodium hydride. In this manner the alkali metal hydride is produced in the cathodic compartment. As seen from the above equations, (6a) and (6b), the standard voltage necessary to carry out this reaction is approximately 1.39 volts. The reaction without hydrogen, as illustrated in equations (4a) and (4b) requires a standard voltage of 2.44 volts. In carrying out the reaction of formula (6a) and (6b), voltages from 1.39 volts to 6 volts are generally utilized. Higher voltages can be used but seldom are since high voltages are energy inefficient when carrying out this process.

In carrying out the reaction in the cell of FIG. 3, a voltage is applied across the anode and cathode so that a current flows through the electrolytic cell while hydrogen or a hydrogen containing gas is passed into the anodic and cathodic compartments to convert the sodium hydroxide into sodium hydride and water. It is important that the membrane 3 does not allow water or water vapor to pass into the cathodic compartment.

The membrane should be composed of a material which is permeable to sodium cation and non-permeable to water and water vapor and which can also withstand temperatures of the reaction, i.e. 100° C. or above. Generally this reaction is carried out at 100° C. to 500° C. depending upon the material present as the membrane and the melting points of the catholyte and anolyte. Generally it is preferred that the membrane 3 be made from a cation-exchange ceramic material such as sodium β"-alumina. In accordance with this embodiment, the cathode can be made of conventional metals which are inert at the high temperatures used for this reaction. Examples of such materials include nickel, copper, stainless steel etc. A hydrogen diffusion electrode with a high specific surface area is preferred for the anode. Such electrodes may include nickel or supported noble metals such as platinum supported on porous nickel or titanium.

This reaction has a standard voltage of 1.39 volts. Cell voltages from 1.39 volts to 6 volts or above can be utilized to carry out this reaction. Generally this reaction is carried out at temperatures which will keep the anolyte and catholyte (for instance, sodium hydroxide) in their molten state. In this regard any temperature which will keep the anolyte and catholyte in their molten state can be utilized. In most cases these are temperatures of at least 300° C. and preferably between 318° C. and 500° C. As the sodium hydride in the cathodic compartment is produced in the electrolysis process it dissolves in to the catholyte. This solute can be continuously or intermittently removed from the cell. The feed molten sodium hydroxide can continuously or intermittently be introduced into the cell and this reaction can be carried out in a continuous or intermittent manner.

FIG. 4 is a schematic diagram illustrating an example of a cell utilizing hydrogen gas at the anode for reducing an ionic alkali metal compound such as sodium borate from a molten salt medium in accordance with another embodiment of this invention. In accordance with this embodiment, hydrogen gas is passed both into the anodic compartment and into the cathodic compartment. The embodiment of FIG. 4, can be specifically illustrated by the production of an alkali metal borohydride from an alkali metal borate, such as an alkali metal metaborate, electrochemically by the following series of reactions.

| | | |
|---|---|---|
| Cathode: | $BO_2^- + 3H_2 + 2e^- \rightarrow BH_4^- + 2OH^-$ | (7a) |
| Anode: | $2OH^- + H_2 - 2e^- \rightarrow 2H_2O$ | (7b) |
| Standard cell voltage = 1.64 V (25° C.) | | |

This is an electrochemical reaction with the transfer of two electrons for every borohydride group formed, in comparison with the eight electrons transferred in reactions (3a) and (3b). While this reaction is illustrated with an alkali metal borate it can be used to reduce a non ionic alkali metal compounds, through the use of a molten medium.

The cathodic compartment contains the cathode electrode 1 and the catholyte 2. The catholyte 2 comprises a mixture of molten alkali metal metaborate and a molten alkali metal hydroxide. The anodic compartment contains the anode electrode 4 and the anolyte 5. A hydrogen sparger 6 is placed into both compartments to pass hydrogen or a hydrogen containing gas from an external source into both of these compartments. The anolyte 5 can be an alkali metal hydroxide melt or a mixture containing molten alkali metal hydroxide, such as its mixture with other alkali metal salts. It is very important that the cathodic compartment is substantially free of water prior to carrying out the electrochemical reaction to produce the borohydride. It is best, for carrying out this process, to use a molten anolyte and catholyte, both of which contain no water.

The borohydride is formed in the cathodic compartment while water is formed in the anodic compartment. The anodic compartment is separated from the cathodic compartment by a membrane 3 which is permeable to the ions of the alkali metal, but non-permeable to the borohydride ion. The membrane should also be non-permeable to water and water vapor which are produced in the electrochemical reaction. The membrane should be composed of a material which is permeable to alkali metal cations and non -permeable to water and water vapor and which can also withstand temperatures of the reaction, i.e. 100° C. or above. Generally this reaction is carried out at 100° C. to 500° C. depending upon the material present as the membrane and the melting points of the catholyte and anolyte. Generally it is preferred that the membrane 3 be made from a cation-exchange ceramic material such as sodium β"-alumina. In carrying out this reaction voltages of from 1.64 to 6 can be applied to the cell to allow an electrical current. Higher voltages can be used but seldom are since high voltages are energy inefficient when carrying out this process.

In this process, hydrogen or a hydrogen containing gas is passed into the cathode and anode compartments through the sparger 6 in each compartment while a voltage is applied to the cell. In this manner water is formed at the anode compartment and the alkali metal borohydride is formed in the cathode compartment. The catholyte can be continuously or intermittently processed to remove the alkali metal borohydride. The residual of the separation process, alkali metal hydroxide, can be returned to the anode side, while alkali metal borate is fed into the cathode compartment. Water and water vapor are the anodic products. At the reaction temperature, this water is expected to be in the form of water vapor. The unreacted hydrogen leaving the anode chamber is expected to carry away a significant portion of this water vapor. It may be desirable to incorporate an alkali metal oxide such as sodium oxide ($Na_2O$) in the cell. The alkali metal oxide can scavenge the remaining water vapor and convert it into sodium hydroxide to prevent it from entering the cathodic reaction site.

A schematic diagram of another embodiment of the aspect of the invention where hydrogen or a hydrogen containing gas is passed into the anodic compartment is shown in FIG. 5. The process set forth in FIG. 5 is for converting an alkali metal ionic inorganic compound to an alkali metal and removing the alkali metal via formation of an amalgam. In this case, the reaction is carried out in a unitary compartment utilizing an aqueous electrolyte. This embodiment is illustrated through the use of an aqueous sodium hydroxide being converted electrolytically to sodium amalgam. FIG. 5 consists of one cell with no need for a divider or membrane. In this embodiment hydrogen-assisted electrolysis is used to convert an aqueous sodium hydroxide solution to sodium amalgam by means of the following equations:

| | | |
|---|---|---|
| Cathode: | $2Na^+ + 2e^- \rightarrow 2Na(amalgam)$ | (5a) |
| Anode: | $2OH^- + H_2 - 2e^- \rightarrow 2H_2O$ | (5b) |
| Standard cell voltage: May vary depending on the choice of cathode. | | |

In such a system it is not necessary to use a separator between the anode and cathode compartments to prevent water from diffusing from the anode side to the cathode side since in this embodiment the electrolyte 2 is an aqueous sodium hydroxide solution and the cathode 1 is made of a metal or metal alloy which reacts with sodium as it is formed to form sodium amalgam. In that way the sodium as it is formed in this cell reacts with the cathode electrode 1 to form the amalgam which removes sodium from the aqueous electrolyte. The anode electrode can be of a hydrogen diffusion electrode with low hydrogen overvoltage, such as noble metal supported on porous nickel or titanium. A hydrogen sparger 4 is placed next to the anode so that it passes hydrogen gas or a hydrogen containing gas into the electrolyte/anode interface during the reaction to form the sodium. The aqueous sodium hydroxide in the electrolyte is converted at the anode to water through reaction with the hydrogen gas. At the cathode 1 the sodium ions are converted to sodium metal which amalgamates with the cathode as soon as it is formed. The cathode material may affect the standard cell voltage. Generally speaking, the standard cell voltage of this reaction is expected to be between 1 V to 1.46 V. In accordance with this reaction a voltage of from 1.5 to 6 volts may be applied to the electrolytic cell of FIG. 5 while hydrogen or a hydrogen containing gas is passed into the cell.

In this manner hydrogen-assisted electrolysis of sodium hydroxide in aqueous solution occurs to form sodium amalgam. The cathode becomes a molten sodium-containing alloy and the cathode can be continuously or intermittently removed from the cell to separate the sodium in it and the sodium depleted metal or alloy sent back to the cell.

In accordance with this invention the cathode can be any metal or metal alloy which will react with sodium to form the sodium amalgam and which will not react with the catholyte. In accordance with this invention such metals or alloys including mercury, lead, bismuth, tin, and indium, or Rose's metal which is an alloy having a composition of 50% by weight bismuth, 25% by weight lead and 25% by weight tin. In carrying out this reaction the temperature will be the temperature at which the metal or metal alloy will melt and will react with sodium to form the sodium amalgam. When mercury is utilized as the cathode this temperature can be room temperature. However, when other metals are utilized the temperature of the cell typically has to be raised to the temperature at which the metal or metal alloy melts since the melting temperature will be the temperature at which the reaction between the metal or metal alloy and sodium can take place.

The sodium hydroxide solution forms the electrolyte will have a pH of 7.5 or above preferably above 13. Higher pH's can be utilized. In carrying out this reaction generally voltages of from about 1 volt and above are utilized. Generally voltages of from about 1.5 to 6 are preferred.

EXAMPLE 1

Hydrogen-assisted electrolysis applied to electrolysis of molten sodium hydroxide to make sodium The electrochemical cell was contained in a nickel crucible. The crucible was submerged into sand at the bottom of a glass jar. The glass jar was closed with an airtight seal. The jar was placed in a heating mantle for heating and drying the NaOH, and then to maintain the cell at the desired reaction temperatures. The crucible was loaded with NaOH and dried under flowing $N_2$ gas at 460° C. overnight. A nickel frit electrode was used on the anode side, while a nickel wire electrode was used on the cathode side. Both electrodes have connectors for connecting to the electrical power source. After drying, the crucible and its contents were cooled to 340° C., a temperature at which they were maintained throughout the duration of the synthesis.

The top of the jar has ports that can be used to introduce electrodes, gas inlets and outlets, and a thermocouple. A reference electrode was used, which consisted of molten sodium in contact with a stainless steel wire and contained inside a sodium β"-alumina tube. This reference reads 0.0 V at the potential where sodium metal was in equilibrium with sodium ions. The inert gas inlet and outlet was connected to a manifold line for proper purging of the reaction vessel. The cathode compartment consists of a sodium β"-alumina tube with an open top. The tube was loaded with 2 g of NaOH and 1 g of dotriacontane hydrocarbon. The tube was placed into the molten sodium hydroxide in the nickel crucible, and its contents allowed to melt. The NaOH melt in the nickel crucible was considered the anolyte, and the NaOH inside the sodium β"-alumina tube was considered to be the catholyte. The sodium β"-alumina was an effective sodium transport membrane and was impermeable to water and water vapor. The dotriacontane hydrocarbon inside the sodium β"-alumina tube was a liquid at 340° C., and floats on top of the catholyte. It effectively separates the catholyte from water vapor and hydrogen gas above the anolyte making the interior of the sodium β"-alumina a fully separated cathode chamber. The catholyte was in electrical contact with the voltage source via a nickel wire, which passes through the liquid hydrocarbon and into the catholyte.

When the cell was completely assembled and both anode and cathode compartments were molten and the jar purged with $N_2$, the $N_2$ flow was stopped and hydrogen gas was then sparged through the nickel frit anode in the cell. The cathode was held at −0.5 V against the reference electrode and the anode voltage was allowed to vary freely, until 1000 milliamp-hours of current had passed. During the time of electolysis, the anode voltage varied between 1.07 and 1.34 V against the reference, with an average value of 1.26 V. The overall cell voltage therefore varied between 1.57 and 1.84 V with an average value of 1.76 V.

Theoretical calculations showed that a current lasting 1000 mAh generates 0.86 g of sodium metal at 100% efficiency. In practice the cell described herein yielded 0.69 g of sodium, for a current efficiency of 80%. The theoretical cell voltage for generation of sodium metal using $H_2$ at the anode was 1.46 V. On average the cell described herein operated at 1.76 V or with 83% voltage efficiency. Combining the current efficiency and the voltage efficiency, the cell produced sodium metal at 66% electrolytic efficiency.

EXAMPLE 2

Hydrogen-assisted electrolysis applied to sodium metaborate dissolved in molten sodium hydroxide to make sodium borohydride.

The electrochemical cell will be contained in a nickel crucible. The crucible will be submerged into sand at the bottom of a glass jar. The glass jar will be closed with an airtight seal. The jar is to be placed in a heating mantle for heating and drying the NaOH and $NaOH/NaBO_2$ mixtures, and then to maintain the cell at the desired reaction temperatures. The crucible will be loaded with NaOH and dried under flowing $N_2$ gas at 460° C. overnight. A nickel frit electrode will be used on both the anode and cathode side. Both electrodes have connectors for connecting to the electrical power source. After drying, the crucible and its contents were cooled to 340° C., a temperature at which they were maintained throughout the duration of the synthesis.

The top of the jar has ports that can be used to introduce electrodes, gas inlets and outlets, and a thermocouple. A reference electrode which consistsing of molten sodium in contact with a stainless steel wire and contained inside a sodium β"-alumina tube can be employed. This reference reads 0.0 V at the potential where sodium metal is in equilibrium with sodium ions. The inert gas inlet and outlet is connected to a manifold line for proper purging of the reaction vessel. The cathode compartment is comprised of a sodium β"-alumina tube with an open top. The tube will be loaded with 5 g of $NaOH/NaBO_2$ mixture that is 10% $NaBO_2$ by weight. The tube will be placed into the molten sodium hydroxide in the nickel crucible, and its contents allowed to melt. The NaOH melt in the nickel crucible is considered the anolyte, and the $NaOH/NaBO_2$ mixture inside the sodium β"-alumina tube is considered to be the catholyte. The sodium β"-alumina is an effective sodium transport membrane and is impermeable to water and water vapor. The catholyte will be in electrical contact with the voltage source via a nickel frit, which is submerged into the liquid catholyte.

When the cell is completely assembled and both anode and cathode compartments are molten and the jar purged with $N_2$, the $N_2$ flow will be stopped and hydrogen gas sparged through the nickel frits in the anode and cathode compartments. The cathode will be held at −0.5 V against the reference electrode and the anode voltage allowed to vary freely, until 1000 milliamp-hours of current have passed.

After the electrolysis, the catholyte is a molten mixture of sodium borohydride, sodium metaborate, sodium hydroxide, and sodium oxide. This can be processed to remove sodium borohydride. At the end of the experiment, the electrode and gas feed assembly will be disconnected and removed from the cell assembly. The molten mix is allowed to cool in the cell. During cooling, agitation may be desirable to break up the solid into smaller pieces. The solidified catholyte material is then mixed with an organic solvent such as diglyme, so that sodium borohydride may be extracted since it is soluble in diglyme, while sodium metaborate, sodium hydroxide, and sodium oxide are not. Further separation of sodium metaborate from sodium hydroxide is achieved by extracting sodium metaborate with methanol. Finally, the sodium hydroxide solution that remains is returned to the anode compartment.

Theoretical calculations show that a current lasting 1000 mAh will generate 0.18 g of sodium borohydride at 100% efficiency. The separated sodium borohydride can be weighed to estimate the current efficiency. The average voltage efficiency can be measured during electrolysis and overall electrolytic efficiency can be estimated.

EXAMPLE 3

Hydrogen-assisted electrolysis applied to sodium hydroxide electrolysis in aqueous solution to form sodium amalgam The electrolytic cell is contained in a crucible which is placed in a glass jar that can be closed with an airtight seal. The crucible will be loaded with an aqueous solution of NaOH. A platinum electrode will be used as the anode. A 2:1:1 mixture of Bi/Pb/Sn mixture (Rose's metal) will be added to the cell to act as the cathode and the alloying material. The platinum electrode should not be in contact with the alloy or the cell body. Both electrodes have connectors for connecting to the electrical power source. The top of the jar has sealable ports that can be used to introduce electrodes, gas inlets and outlets, and a thermocouple. The crucible will be used as a pseudo reference electrode.

The temperature of the cell will be raised gradually by the heating mantle, until the Rose's metal is melted. The output of the heating mantle will be controlled by a variac. The temperature is then maintained at the level necessary to keep the Rose's metal in its molten state, while the electrolyte stays in liquid phase.

Hydrogen will be sparged into the cell in the vicinity of the anode electrode, and at the same time a direct current with a voltage of greater than 1.5 V, preferably in the 1.7–2.5 V range, will be applied. The un-reacted hydrogen gas will flow out of the cell assembly through the gas outlet. Sodium will form at the Rose's metal cathode and immediately react with the Rose's metal to give sodium/Rose's metal amalgam. Water will form at the platinum anode.

What is claimed:

1. A process for reducing in an electrolytic cell an ionic alkali metal compound, said cell containing anode and cathode compartments, comprising:

supplying said alkali metal compound in molten form to at least the cathodic compartment in the electrolytic cell, at least said cathodic compartment being substantially free of water, said anodic and cathodic compartments being separated by a membrane which is permeable to alkali metal ions but is not permeable to water and water vapor;

applying an electric voltage to said cell to reduce said alkali metal compound at said cathode; and electro-oxidizing hydrogen or a hydrogen containing gas at the anode while said compound is reduced at the cathode

2. The process of claim 1 wherein said alkali metal is sodium.

3. The process of claim 1, further comprising passing hydrogen into the cathode compartment so as to react with said reduced compound.

4. The process of claim 2 wherein said compound is sodium hydroxide.

5. The process of claim 1 wherein the alkali metal compound is supplied in the molten state by dissolving said compound in a molten solvent.

6. A process of electrolyzing alkali metal hydroxide in an electrolytic cell containing anodic and cathodic compartments to produce an alkali metal comprising:

providing molten alkali metal hydroxide to both the cathodic and anodic compartments in the electrolytic cell, at least said cathodic compartment being substantially free of water, said anodic and cathodic compartments being separated by a membrane which is permeable to alkali metal ions but is not permeable to water and water vapor;

applying a voltage to the cell; and electro-oxidizing hydrogen or a hydrogen containing gas at said anode while said electric voltage is applied to form the metallic alkali metal in said cathodic compartment.

7. The process of claim 6 wherein the alkali metal formed in the cathodic compartment is continuously removed from the cell and alkali metal hydroxide is continuously supplied to the anodic compartment.

8. The process of claim 7 wherein the cell is maintained at a temperature during the formation of alkali metal sufficient to keep the alkali metal hydroxide in its molten state.

9. The process of claim 6 wherein said alkali metal is sodium.

10. A process for reducing in an electrolytic cell a sodium borate compound, said cell containing anode and cathode compartments, comprising:

supplying said sodium borate compound in molten form to at least the cathodic compartment in the electrolytic cell, at least said cathodic compartment being substantially free of water, said anodic and cathodic compartments being separated by a membrane which is permeable to alkali metal ions but is not permeable to water and water vapor;

applying an electric voltage to said cell to reduce said sodium borate compound at said cathode; and passing hydrogen or a hydrogen containing gas in the anode compartment while said sodium borate compound is reduced at the cathode.

* * * * *